US010266301B2

(12) United States Patent
Rudolf

(10) Patent No.: US 10,266,301 B2
(45) Date of Patent: Apr. 23, 2019

(54) ROUND CORNER CONTAINER

(71) Applicant: PHILIP MORRIS PRODUCTS S.A., Neuchatel (CH)

(72) Inventor: David Rudolf, Kutna Hora (CZ)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/536,227

(22) PCT Filed: Dec. 30, 2015

(86) PCT No.: PCT/EP2015/081413
§ 371 (c)(1),
(2) Date: Jun. 15, 2017

(87) PCT Pub. No.: WO2016/107900
PCT Pub. Date: Jul. 7, 2016

(65) Prior Publication Data

US 2017/0349319 A1 Dec. 7, 2017

(30) Foreign Application Priority Data

Dec. 31, 2014 (EP) ..... 14200731

(51) Int. Cl.
*B65D 5/42* (2006.01)
*B65D 85/10* (2006.01)
*B31B 50/00* (2017.01)

(52) U.S. Cl.
CPC ..... *B65D 5/4266* (2013.01); *B65D 85/1045* (2013.01); *B31B 50/00* (2017.08)

(58) Field of Classification Search
CPC ..... B31B 50/00; B65D 5/42; B65D 5/4266; B65D 5/66; B65D 5/6691; B65D 85/10; B65D 85/1045
(Continued)

(56) References Cited

U.S. PATENT DOCUMENTS 3,526,566 A * 9/1970 McIlvain, Jr. ..... B31F 1/08 229/930
4,026,458 A * 5/1977 Morris ..... B31F 1/0077 229/182.1
(Continued)

FOREIGN PATENT DOCUMENTS

CA 2437936 8/2002
CN 1496326 5/2004
(Continued)

OTHER PUBLICATIONS

International Search Report and Written Opinion for PCT/EP2015/081413 dated Feb. 29, 2016 (11 pages).
(Continued)

*Primary Examiner* — Bryon P Gehman
(74) *Attorney, Agent, or Firm* — Mueting, Raasch & Gebhardt, P.A.

(57) ABSTRACT

A container for consumer articles is at least partially formed from a blank defining a portion of the container, which comprises a first and a second planar walls connected to one another by a curved edge portion. An inner surface of the curved edge portion defines an ablation area (A) having a length (L) in the longitudinal direction of the curved edge portion and a width (W) that extends along the curve of the curved edge portion. The ablation area comprises a plurality of pairs of ablation lines, all of which extend in parallel in the longitudinal direction of the curved edge portion. The distance (X) between two ablated zones in each pair as measured along the width (W) of the ablation area is less than the distance (Y) between two adjacent pairs of ablated zones as measured along the width (W) of the ablation area.

17 Claims, 2 Drawing Sheets

(58) Field of Classification Search
USPC ..... 229/182, 1, 930, 931
See application file for complete search history.

(56) References Cited

U.S. PATENT DOCUMENTS

| | | | | |
|---|---|---|---|---|
| 4,955,531 | A * | 9/1990 | Graboyes | B31F 1/08 229/182.1 |
| 5,133,460 | A * | 7/1992 | Shuert | B65D 5/4266 108/55.1 |
| 5,143,282 | A * | 9/1992 | Pham | B65D 5/6691 229/148 |
| 5,924,627 | A * | 7/1999 | Wilder | B65D 5/4266 229/182.1 |
| 6,004,251 | A | 12/1999 | Herrin | |
| 6,592,023 | B2 | 7/2003 | LiVigni | |
| 7,044,294 | B2 * | 5/2006 | Lutzig | B65D 5/6691 206/259 |
| 8,157,087 | B2 * | 4/2012 | Tanbo | B65D 85/1045 206/268 |
| 2005/0199692 | A1 * | 9/2005 | Nelson | B65D 5/029 229/182.1 |
| 2006/0006078 | A1 | 1/2006 | Vaccari | |

FOREIGN PATENT DOCUMENTS

| | | |
|---|---|---|
| CN | 1602274 | 3/2005 |
| CN | 1652985 | 8/2005 |
| DE | 102011109363 | 2/2013 |
| EP | 0900736 | 3/1999 |
| EP | 2141090 | 1/2010 |
| EP | 2700583 | 2/2014 |
| GB | 2358176 | 7/2011 |
| JP | 2022729 | 2/2009 |

OTHER PUBLICATIONS

Office Action issued in Europe for Application No. 15817424.3 dated Jun. 21, 2018 (6 pages).
Office Action issued in China for Application No. 201580068270.9 dated Aug. 20, 2018 (14 pages). English translation included.

* cited by examiner

ROUND CORNER CONTAINER

This application is a U.S. National Stage Application of International Application No. PCT/EP2015/081413, filed Dec. 30, 2015, which was published in English on Jul. 7, 2016, as International Publication No. WO 2016/107900 A1. International Application No. PCT/EP2015/081413 claims priority to European Application No. 14200731.9 filed Dec. 31, 2014.

The present invention relates to a container for consumer goods and to a blank for forming such container, which find particular application for holding elongate consumer goods, such as smoking articles (for example, cigarettes).

Smoking articles such as cigarettes and cigars are usually provided in soft-pack packs or hard-pack packs, such as flip-top boxes or hinge-lid boxes. These typically have a box part having a box front wall, a box rear wall, box side walls and a box base. They also usually have a lid part with a lid front wall, a lid rear wall, lid side walls and a lid top side. The lid part is typically hinged to the box part along a hinge line extending across a back wall of the container. The hinge line is usually provided as a pre-folded line, a crease line or a score line.

For hard-pack packs, it is known to round off or chamfer certain corners of the box and lid to give the container a distinctive appearance. This has typically been achieved in the past by providing creasing lines or scoring lines in the blank at the areas forming the edges of the container. These lines allow the blank to be folded in such a way that the corner does not sharply bend but instead progressively bends between two adjacent walls.

However, such scoring or creasing lines can add complexity to the manufacturing process and can also result in the container having a weakened strength. Furthermore, in some cases, the visual and tactile perception of the container may be impacted, in that the outer surface of the rounded corners is not entirely smooth and can include ridges or ripples from where the creasing has occurred.

It would therefore be desirable to provide a container for consumer goods having rounded corners that has an improved look and provides the consumer with a smoother feel. It would also be desirable to provide to provide a container for consumer goods having rounded corners that has improved strength and which is easier to produce. Further, it would be desirable to provide a blank for manufacturing a container for consumer goods that make the production and assembly process easier and more flexible.

According to the present invention, there is provided a container for consumer articles, the container being at least partially formed from a laminar blank having a thickness (T). The laminar blank defines a portion of the container, which comprises at least a first planar wall and a second planar wall that are connected to one another by a curved edge portion. The curved edge portion has an inner surface and an outer surface, and the inner surface of the curved edge portion defines an ablation area (A). The ablation area has a length (L) in the longitudinal direction of the curved edge portion and a width (W) that extends along the curve of the curved edge portion. Further, the ablation area comprises a plurality of pairs of ablation lines, all the ablation lines extending in parallel in the longitudinal direction of the curved edge portion. In addition, the distance (X) between two ablated lines in each pair as measured along the width (W) of the ablation area is less than the distance (Y) between two adjacent pairs of ablated lines as measured along the width (W) of the ablation area.

In contrast to known containers, material is removed at specific locations within the portion of the blank that forms a rounded corner of the container. In more detail, material is removed along pairs of parallel ablation lines extending substantially along an edge of a planar wall of the container such that the distance between two score lines in a pairs is less than the distance between adjacent pairs of parallel ablation lines. Surprisingly, it has been found that bending of the blank of the present invention, when forming a rounded edge of a container, is easier, and results in the formation of an outer surface of the container that is smoother upon visual and tactile inspection on the part of the consumer. Further, the rounded edge of the container effectively approximates the theoretical, reference rounded shape with a relatively small number of score lines. Thus, at the same time, the strength of the container at the rounded edges may be better preserved.

It is easy to form the rounded edges of a container according to the present invention. is When the blank is bent into shape at the rounded edges, a portion of the total deflection is absorbed by each reduced thickness portion of the ablation area, so that the resulting container edge can form a gradual curve rather than a plurality of sharp creases. Further, because of the specific arrangement of the ablation lines over the portion of the blank that forms a rounded corner of the container, the curvature of the outer surface of the container is more effectively distributed over the whole width of the curved edge portion. This advantageously results in a more gradual curvature that better approximates a theoretical curved profile.

Because the outer surface of the blank is unaffected by the ablation process, the resulting outer surface of the container is smoother upon visual and tactile inspection on the part of the consumer. Without wishing to be bound to theory, the Applicant has observed that because this smooth, rounded surface can be obtained with a relatively small number of ablation lines, and therefore with limited material removal, the strength of the container at the rounded corners may, to an extent, be adjusted, so that appearance and resistance of the container are both improved.

Further, the blank may advantageously be manufactured by precisely removing material from the round corner portion with a linear ablation tool (for example, a laser or a blade). A laser is a particularly preferred ablation tool, as it is non-invasive and can be digitally programmed for improved flexibility of design. In particular, use of a laser as the ablation tool can allow for a wide variety of ablation profiles and configurations, with minimal adjustment of the laser tool being needed. Repeated passages of the ablation tool over a given portion of the blank results in the removal of a greater percentage of material, that is in a reduced residual thickness. Thus, the manufacturing process can be simplified.

The term "inner surface" is used throughout the specification to refer to the side of a portion of the blank that, once the container is assembled, faces towards the interior of the container, for example towards the consumer goods, when the container is closed. Thus, the inner surface is not directly visible for the consumer when the container is closed. The term "outer surface" is used throughout the specification to refer to the side of a portion of the blank that, once the container is assembled, faces away from the container.

The term "curved edge portion" is used herein to refer to an edge portion of the container having an arc-like shape as viewed in cross-section. By the term "arc-like" reference is made to any non-straight line, including circular arc, parabolic arc, hyperbolic arc, elliptical arc, etc.

The term "ablation area" is used herein to refer to the minimum area of the blank that encloses all ablated lines on the on the portion of the blank that forms the curved edge portion of the container.

The term "ablated line" is used herein to refer to an area of the curved edge portion is from which material has been ablated (e.g. removed by means of a laser beam or a blade) from a surface of the laminar blank or container. Accordingly, the residual thickness of an ablated line is less than the thickness (T) of the laminar blank. Preferably, an ablated line is provided as a groove within the blank. This may be formed with an linear ablation tool, particularly a linear ablation tool, such as a laser or a blade. In embodiments where all the ablated lines are defined by parallel grooves within the blank, the area of the ablation area may be regarded as the area enclosing all the grooves on the curved edge portion. Thus, in those embodiments, the width of the ablation area may be regarded as extending transversely to the grooves, from the first to the last of the grooves on the curved edge portion.

The term "residual thickness" is used herein to refer to the minimum distance measured between two opposite surfaces of the laminar blank or of a wall of the container formed from the blank. In practice, the distance at a given location is measured along a direction locally perpendicular to the opposite surfaces. The "residual thickness" of an ablated zone may be constant over the ablated zone if material is removed homogenously substantially all over the ablated zone (flat profile). Alternatively, the residual thickness of the ablated zone may vary across a width of the ablated zone, if material is removed non-homogeneously over the ablated zone (e.g. V-shaped, U-shaped grooves).

The expression "distance between ablation lines in a pair of ablation lines" is used to describe the width of the portion of ablated area between two ablation lines in a single pair of ablation lines. Such distance is construed as being measured along the width of the ablation area and between the respective symmetry axes of the ablation lines. In practice, because the ablation lines extend along the length of the ablation area, the distance between adjacent ablation lines in a single pair is measured substantially perpendicular to the lines themselves.

The expression "distance between adjacent pairs of ablation lines" is used to describe the width of the portion of ablation area separating two adjacent pairs of ablated zones. Such distance is construed as being measured along the width of the ablation area. In practice, because the ablation lines extend along the length of the ablation area, the distance between adjacent pairs of ablation lines is measured substantially perpendicular to the main axis of the ablated zones.

The term "proximate to" is used throughout this specification to describe a pair of ablation lines immediately adjacent another element of the container, such as a planar wall thereof. In practice, in some embodiments, one of the ablation lines of the first pair adjacent a first planar wall of the container extends substantially at the border between the first planar wall of the container and the curved edge portion connecting the first planar wall to a second planar wall of the container.

As used herein, the terms "front", "back", "upper", "lower", "top", "bottom" and "side", refer to the relative positions of portions of containers according to the invention and components thereof when the container is in an upright position with the lid of the outer housing in the closed position and the hinge line at the back of the container. When describing containers according to the present invention, these terms are used irrespective of the orientation of the container being described. The back wall of the container is the wall comprising the hinge line.

The term "inner surface" is used throughout the specification to refer to the side of a portion of the blank that, once the container is assembled, faces towards the interior of the container, for example towards the consumer goods, when the container is in the closed position. The term "outer surface" is used throughout the specification to refer to the side of a portion of the blank that, once the container is assembled, faces away from the container.

The term "spring-back force" is a known term of art for referring to a particular property of a laminar blank. It is sometimes referred to as 'the crease recovery' and means the force (N) required to hold a scored sample that is folded at 90 degrees for a 15-second period. The measurement is made at the end of the 15-second period. The spring-back force of a portion of a laminar blank can be measured using a known PIRA Crease and Board Stiffness Tester (commercially available for example from Messmer and Buchel, UK). As is known in the art, to measure the spring-back force of a curved edge portion of a container, a sample of the portion to be tested should first be removed from the laminar blank. As shown in FIG. 1, for round corner packs, for the purposes of the present invention the spring-back force of a pack is assessed using a sample measuring 38±1 millimeters by 38±0.5 millimeters, with the corner forming portion being positioned 21±0.5 millimeters from one side of the blank (see also FIG. 2). The blank should be conditioned at 22 degrees Celsius and 60 percent relative humidity for at least 24 hours prior to testing.

Containers according to the present invention are at least partially formed from a laminar blank having a predetermined thickness. The blank defines a portion of the container, which comprises at least a first planar wall and a second planar wall that are connected to one another by a curved edge portion. An inner surface of the curved edge portion defines an ablation area that has a length in the longitudinal direction of the curved edge portion and a width that extends along the curve of the curved edge portion. The ablation area comprises a plurality of pairs of ablation lines, all of which extend in parallel in the longitudinal direction of the curved edge portion. The distance between two ablation lines in each pair as measured along the width of the ablation area is less than the distance between two adjacent pairs of ablation lines as measured along the width of the ablation area.

Preferably, the distance (X) between two ablation lines in each pair is less than about 1 millimeter. More preferably, the distance (X) between two ablation lines in each pair is less than about 0.8 millimeters. In addition, the distance (X) between two ablation lines in each pair is preferably at least about 0.4 millimeters. More preferably, the distance (X) between two ablation lines in each pair is preferably at least about 0.6 millimeters.

Preferably, the distance (Y) between two adjacent pairs of ablation lines is less than about 1.2 millimeters. More preferably, the distance (Y) between two adjacent pairs of ablation lines is less than about 1 millimeter. In addition, or as an alternative, the distance (Y) between two adjacent pairs of ablation lines is at least about 0.6 millimeters. More preferably, the distance (Y) between two adjacent pairs of ablation lines is at least about 0.8 millimeters.

Without wishing to be bound by theory, it has been identified that a particular ratio of the distance (X) between two ablation lines in each pair, with respect to the distance (Y) between two adjacent pairs of ablation lines can provide particularly smooth looking round corner portions, with relatively few ablation lines. In particular, preferably the distance (X) between two ablation lines in each pair is between about 70 percent and about 85 percent of the distance (Y) between two adjacent pairs of ablation lines, more preferably between about 75 percent and about 80 percent of the distance (Y) between two adjacent pairs of ablation lines.

Preferably, the ablated width of each ablation lines is at least about 0.01 millimeters. More preferably, the ablated width of each ablation lines is at least about 0.05 millimeters. In addition, or as an alternative, the ablated width of each ablation lines is less than about 0.4 millimeters. More preferably, the ablated width of each ablation lines is less than about 0.2 millimeters. In some preferred embodiments, the ablated width of each ablation lines is from about 0.01 millimeters to about 0.4 millimeters. Even more preferably, the ablated width of each ablation lines is from about 0.05 millimeters to 0.2 millimeters.

Preferably, each of the ablation lines has a residual thickness of at least about 5 percent of the thickness (T) of the blank. More preferably, each of the ablation lines has a residual thickness of at least about 10 percent of the thickness (T) of the blank. Even more preferably, each of the ablation lines has a residual thickness of at least about 20 percent of the thickness (T) of the blank. In addition, or as an alternative, each of the ablation lines has preferably a residual thickness of less than about 50 percent of the thickness (T) of the blank. More preferably, each of the ablation lines has a residual thickness of less than about 40 percent of the thickness (T) of the blank. Even more preferably, each of the ablation lines has preferably a residual thickness of less than about 30 percent of the thickness (T) of the blank. In some particularly preferred embodiments, each of the ablation lines has preferably a residual thickness of about 20 percent of the thickness (T) of the blank.

Preferably, the width of the ablation area is at least about 3 millimeters. More preferably, the width of the ablation area is at least about 5 millimeters. In addition, or as an alternative, the width of the ablation area is preferably less than about 10 millimeters. More preferably, the width of the ablation area is less than about 8 millimeters.

In some preferred embodiments, the ablation area comprises at least a first pair of ablation lines proximate to the first planar wall and a second pair of ablation lines proximate to the second planar wall.

In some alternative embodiments, the ablation area comprises a first single ablated zone and a second single ablated zone adjoining the first planar wall and the second planar wall, respectively. Further, the ablation area comprises at least a first pair of ablation lines and a second pair of ablation lines extending between the first and the second single ablated zone. The distance (Z1) between the first pair of ablation lines and the first single ablation line or the distance (Z2) between the second pair of ablation lines and the second single ablation line or both is greater than the distance (X) between two ablation lines in each pair as measured along the width (W) of the ablation area. Preferably, the distance (Z1) between the first pair of ablated zones and the first single ablated zone is substantially equal to the distance (Z2) between the second pair of ablated zones and the second single ablated zone.

The distance (Z1) between the first pair of ablated zones and the first single ablated zone is preferably at least about 0.6 millimeters, more preferably at least 0.8 millimeters. Preferably, the distance (Z1) between the first pair of ablated zones and the first single ablated zone is less than about 1.2 millimeters.

Preferably, the container has a spring-back force of less than about 10 milliNewton meters between the two planar walls that are connected by the curved edge portion.

In some preferred embodiments, the laminar blank forms at least a part of the container comprising a box portion having a box front wall, a box rear wall and box side walls extending between the box front wall and the box rear wall, and wherein the curved edge portion connects one of the box side walls to the box front wall or the box rear wall. Alternatively or additionally, the curved edge portion may connect a box bottom wall with one of the box side walls, box front wall or the box rear wall.

In addition, or in alternative embodiments, the laminar blank preferably forms at least a part of the container comprising a lid portion having a lid front wall, a lid rear wall and lid side walls extending between the lid front wall and the lid rear wall, and wherein the curved edge portion connects one of the lid side walls to the lid front wall or the lid rear wall. Alternatively or additionally, the curved edge portion may connect a lid top wall with one of the lid side walls, lid front wall or the lid rear wall.

Containers according to the present invention find application as containers for consumer goods, in particular elongate consumer goods such as smoking articles. However, they can also be used for several other types of consumer goods.

The blank may be formed from any suitable material or combination of materials, including, but not limited to, cardboard, paperboard, plastic, metal, or combinations thereof. Preferably, the blank is a laminar cardboard blank having a weight of between about 100 grams per square meter and about 350 grams per square meter. In preferred embodiments, the blank has a thickness of from about 100 micrometers to about 500 micrometers, preferably from about 200 micrometers to about 350 micrometers.

The container may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Further, the consumer articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which consumer goods can be removed when a lid of the container is in a respective open position.

The container is preferably a rectangular parallelepiped comprising two wider walls spaced apart by two narrower walls. Hinge lid containers according to the invention may be in the shape of a rectangular parallelepiped, with right-angled longitudinal and right-angled transverse edges. Alternatively, the hinge lid container may comprise one or more rounded longitudinal edges, rounded transverse edges, bevelled longitudinal edges or bevelled transverse edges, or combinations thereof. For example, the hinge lid container according to the invention may comprise, without limitation:

One or two longitudinal rounded edges on the front wall, and/or one or two longitudinal rounded or bevelled edges on the back wall.

One or two transverse rounded edges on the front wall, and/or one or two transverse rounded or bevelled edges on the back wall.

One longitudinal rounded edge and one longitudinal bevelled edge on the front wall, and/or one transverse rounded edge and one transverse bevelled edge on the back wall.

One or two transverse rounded or bevelled edges on the front wall and one or two longitudinal rounded or bevelled edges on the front wall.

Two longitudinal rounded or bevelled edges on a first side wall or two transverse rounded or bevelled edges on the second side wall.

Where the container comprises one or more bevelled edge, preferably the bevelled edge has a width of between about 1 mm and about 10 mm, preferably between about 2 and about 6 mm. Alternatively, the container may comprise a multi-bevelled edge formed by parallel creasing or scoring lines that are spaced such that two or more distinct bevels are formed on at least one edge of the container.

Alternatively, the container may have a non-rectangular transversal cross section, for example polygonal such as triangular or hexagonal, semi-oval or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles.

The smoking articles may be arranged in different collations, depending on the total number of smoking articles.

Containers according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that the resultant overall dimensions of the container are similar to the dimensions of a typical disposable pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

Preferably, the ratio of the height of the lid back wall to the height of the box back wall of the outer sleeve is between about 0 to 1 (lid located at the top edge of the container) to about 1 to 1, more preferably, between about 1 to 5 and about 1 to 10, most preferably, between about 1 to 6 to about 1 to 8.

Preferably, the ratio of the height of the lid front wall of the outer sleeve to the height of the box front wall of the outer sleeve is between about 1 to 0 (lid covering the entire front wall) to about 1 to 10, more preferably, between about 1 to 1 and about 1 to 5, most preferably, between about 1 to 2 and about 1 to 3.

The exterior surfaces of containers according to the invention may be printed, embossed, debossed or otherwise embellished with manufacturer or brand logos, trade marks, slogans and other consumer information and indicia.

Containers according to the invention may be filled and assembled using conventional apparatus and methods, modified to include the step of forming the ablated zones in the blank. The ablated zones may be produced using an ablation tool, such as a laser or a blade. A laser is particularly preferred as the ablation tool as it can allow for a wide variety of ablation profiles and configurations, with minimal adjustment of the laser tool being needed. For example, the laser may be repeatedly passed over a given portion of the blank to iteratively remove different amounts of material, allowing for a very finely controlled ablation profile. This is particularly beneficial if the ablation line is to have a wide profile, such as one more than about 3 mm wide. It is also beneficial if fine ablated lines are required, with narrow widths. It is possible to accurately control the relative movement of the laser and the blank so as to form any type of pattern with varying removal intensity ("depth") over the ablation area.

The invention will be further described, by way of example only, with reference to the accompanying drawings in which.

Figure 1:
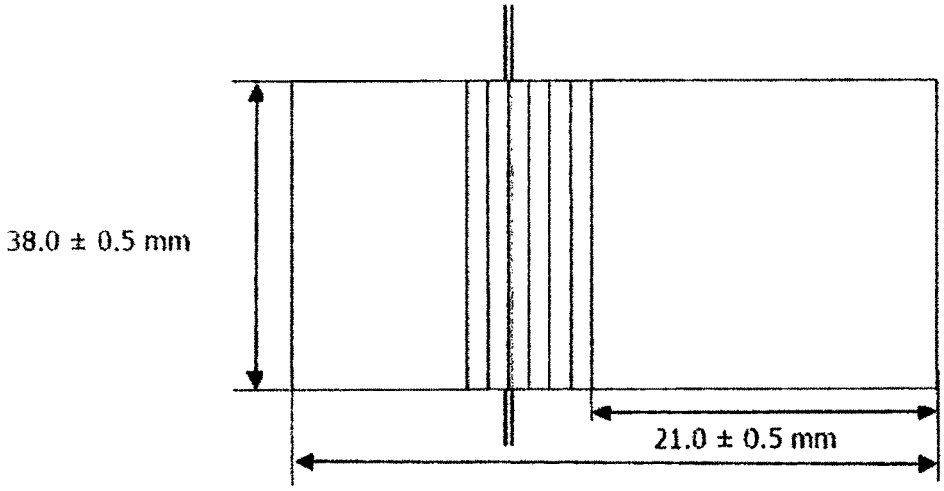
FIG. 1 depicts a sample portion of a laminar blank for use in determining the spring-back force of the blank.
Figure 2:
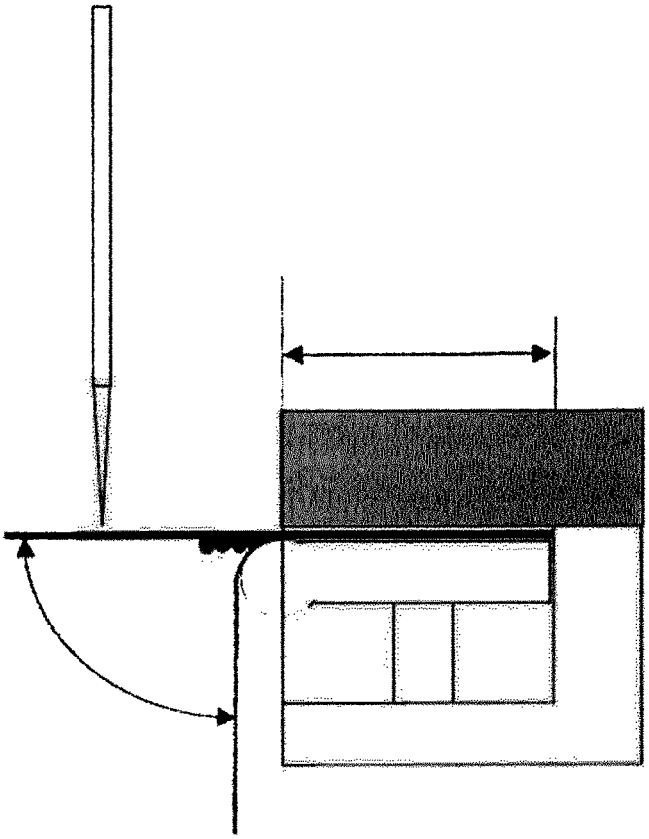
FIG. 2 depicts an apparatus for determining the spring-back force of a blank.

The skilled person shall appreciate that, starting from a laminar blank, a container can be formed that is rectangular parallelepipedal in shape and comprises a box portion and a hinge lid connected to the box portion along a hinge line extending across the back wall of the container. The overall size and construction of the box and lid of the container shall be substantially the same as those of a standard hinge lid cigarette pack. The box portion shall comprises a box front wall, a box back wall, a box bottom wall, a box left side wall and a box right side wall. The hinge lid shall comprises a lid front wall, a lid back wall, a lid top wall, a lid left side wall and a lid left side wall. The hinge lid shall be pivotable about the hinge line between a closed position and an open position. In the closed position, the hinge lid shall cover an access opening of the container and the walls of the hinge lid shall form extensions of the corresponding walls of the box portion. In the open position, the hinge lid shall pivot about the hinge line to project backwardly from the box portion and the access opening at the top end of the box portion shall be fully uncovered. The box portion and the hinge lid may be formed together from a single laminar blank having a thickness T. The container may be assembled from the laminar blank and filled using standard apparatus.

In even more detail, the laminar blank shall define the box front wall that is connected to the box left side wall and the box right side wall by respective curved edge portions. The inner surface of each curved edge portion defines an ablation area, the features of which will be described in greater detail with reference to the Examples 1, 1A and 1B below.

COMPARATIVE EXAMPLE1

The inner surface of the curved edge portion defines an ablation area having 21 equally spaced ablation lines. Each ablation line had a width of approximately 0.1 mm, and a residual thickness of about 20 percent of the thickness (T) of the laminar blank. Upon folding, a smooth round corner was visible on the outer surface of the blank in the curved edge portion. Therefore, the arrangement of Comparative Example 1 was found to result in the formation of a smooth rounded corner, but has the drawback of a complex and lengthy manufacturing process, because numerous ablation lines are required.

COMPARATIVE EXAMPLE2

The inner surface of the curved edge portion defines an ablation area having 6 equally spaced ablation lines. Each ablation line had a width of approximately 0.1 mm, and a residual thickness of about 20 percent of the thickness (T) of the laminar blank. The spacing between adjacent ablation lines was about 1 millimeter. Upon folding, multiple facets became clearly visible on the outer surface of the blank in the curved edge portion, resulting in a non-even curvature.

EXAMPLE 1

The inner surface of the curved edge portion defines an ablation area (A) having a length (L) in the longitudinal direction of the curved edge portion and a width (W) that extends along the curve of the curved edge portion. The ablation area has 3 pairs of ablation lines, each line having an ablated width of about 0.1 millimeters, all the ablation lines extending in parallel in the longitudinal direction of the curved edge portion. The distance (X) between two ablation lines in each pair as measured along the width (W) of the ablation area is less than the distance (Y) between two adjacent pairs of ablation lines as measured along the width (W) of the ablation area. In more detail, the distance (X) between two ablation lines in each pair as measured along the width (W) of the ablation area is about 0.8 millimeters. The distance (Y) between two adjacent pairs of ablation lines as measured along the width (W) of the ablation area is about 1 millimeter.

EXAMPLE 1A

Figure 3:
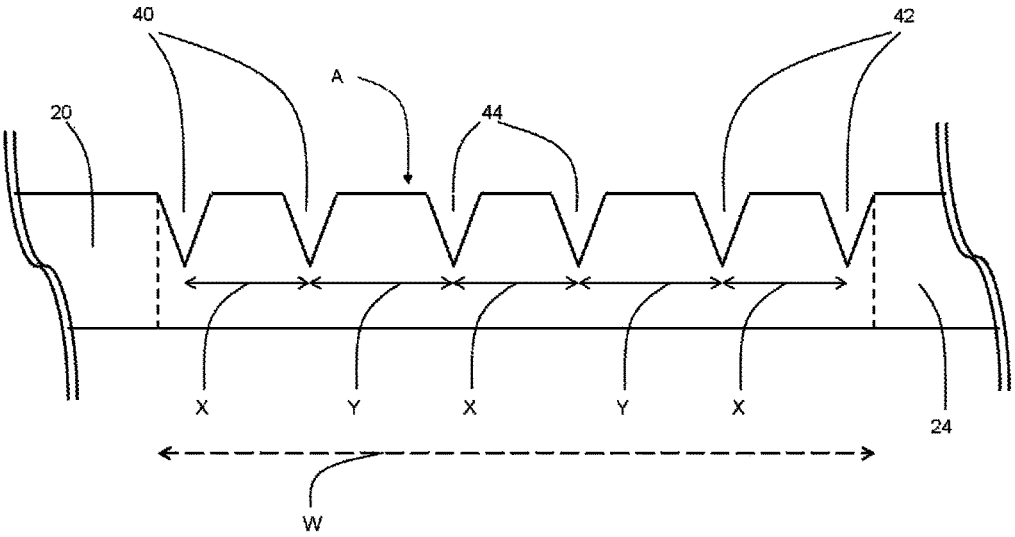
FIG. 3 shows a schematic cross-sectional view of an ablation area in a container or blank in accordance with a first embodiment of the present invention.

As illustrated in FIG. 3, the ablation area A comprises a first pair 40 of ablation lines proximate to the box front wall 20 and a second pair 42 of ablation lines proximate to the box right wall 24. The distance X between two ablation lines in each of the pairs 40, 42 as measured along the width W of the ablation area is about 0.8 millimeters. Further, the ablation area comprises another pair 44 of ablation lines. The distance Y between two adjacent pairs of ablation lines, such as for example the distance between pair the 40 and the pair 44, as measured along the width W of the ablation area, is about 1 millimeter. When the blank of Example 1A was folded, a smooth round corner was visible on the outer surface of the blank in the curved edge portion.

EXAMPLE 1B

Figure 4:
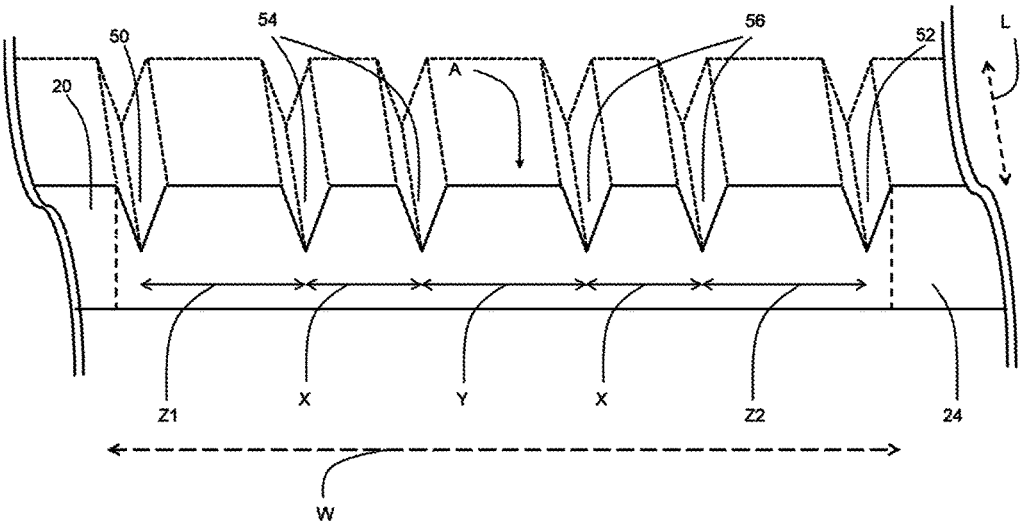
FIG. 4 shows a schematic cross-sectional view of an ablation area (having a length (L) and width (W)) in a container or blank in accordance with a second embodiment of the present invention.

As illustrated in FIG. 4, the ablation area A comprises a first single ablation line 50 and a second single ablation line 52 proximate to the box front wall 20 and the box right wall 24, respectively. The ablation area A further comprising a first pair of ablation lines 54 and a second pair of ablation lines 56 extending between the first and the second single ablation lines 50, 52. The distance Z1 between the first pair of ablation lines 54 and the first single ablation line 50 is substantially equal to the distance Z2 between the second pair of ablation lines 56 and the second single ablation line 52.

In more detail, the distance Z1 between the first pair of ablation lines 54 and the first single ablation line 50 is about 1 millimeter. Further, the distance X between two ablation lines in each of the pairs 54, 56 as measured along the width W of the ablation area is about 0.8 millimeters. On the other hand, the distance between two adjacent pairs of ablation lines, such as for example the distance Y between the pair 54 and the pair 56, as measured along the width W of the ablation area, is about 1 millimeter. When the blank of Example 1B was folded, a smooth round corner was visible on the outer surface of the blank in the curved edge portion.

The invention claimed is:

1. A container for consumer articles, the container being at least partially formed from a laminar blank having a thickness (T), the laminar blank defining a portion of the container, which comprises at least a first planar wall and a second planar wall that are connected to one another by a curved edge portion;

wherein the curved edge portion has an inner surface and an outer surface, and the inner surface of the curved edge portion defines an ablation area (A), the ablation area having a length (L) in the longitudinal direction of the curved edge portion and a width (W) that extends along the curve of the curved edge portion; and wherein the ablation area comprises a plurality of pairs of ablation lines, all the ablation lines extending in parallel in the longitudinal direction of the curved edge portion, wherein the distance (X) between two ablation lines in each pair as measured along the width (W) of the ablation area is less than the distance (Y) between two adjacent pairs of ablation lines as measured along the width (W) of the ablation area.

2. A container according to claim 1, wherein the distance (X) between two ablation lines in each pair is less than 1 millimeter.

3. A container according to claim 1, wherein the distance (X) between two ablation lines in each pair is at least 0.4 millimeters.

4. A container according to claim 1, wherein the distance (Y) between two adjacent pairs of ablation lines is less than 1.2 millimeters.

5. A container according to claim 1, wherein the distance (Y) between two adjacent pairs of ablation lines is at least 0.6 millimeters.

6. A container according to claim 1, wherein the distance (X) between two ablation lines in each pair is between 70 percent and 85 percent of the distance (Y) between two adjacent pairs of ablation lines.

7. A container according to claim 1, wherein an ablated width (WA) of each ablated line is from 0.01 millimeters to 0.4 millimeters.

8. A container according to claim 1, wherein an ablated width (WA) of each ablated line is from 0.05 millimeters to 0.2 millimeters.

9. A container according to claim 1, wherein each of the ablation lines has a residual thickness of less than 50 percent of the thickness (T) of the laminar blank.

10. A container according to claim 1, wherein each of the ablation lines in the plurality of pairs of ablation lines has a residual thickness of at least 5 percent of the thickness (T) of the laminar blank.

11. A container according to claim 1, wherein the width (W) of the ablation area is between 3 millimeters and 10 millimeters.

12. A container according to claim 1, wherein the ablation area comprises at least a first pair of ablation lines proximate to the first planar wall and a second pair of ablation lines proximate to the second planar wall.

13. A container according to claim 1, wherein the ablation area comprises a first single ablation line and a second single ablation line proximate to the first planar wall and the second planar wall, respectively; the ablation area further comprising at least a first pair of ablation lines and a second pair of ablation lines extending between the first and the second single ablation line, wherein the distance (Z1) between the first pair of ablation lines and the first single ablation line or the distance (Z2) between the second pair of ablation lines and the second single ablation line or both is greater than the distance (X) between two ablation lines in each pair as measured along the width (W) of the ablation area.

14. A container according to claim 13, wherein the distance (Z1) between the first pair of ablation lines and the first single ablation line is at least 0.6 millimeters.

15. A container according to claim 1, wherein the container has a spring-back force of less than 10 milliNewton meters between the two planar walls that are connected by the curved edge portion.

16. A container according to claim 1, wherein the laminar blank forms at least a part of the container comprising a box portion having a box front wall, a box rear wall and box side walls extending between the box front wall and the box rear wall, and wherein the curved edge portion connects one of the box side walls to the box front wall or the box rear wall.

17. A container according to claim 1, wherein the laminar blank forms at least a part of the container comprising a lid portion having a lid front wall, a lid rear wall and lid side walls extending between the lid front wall and the lid rear wall, and wherein the curved edge portion connects one of the lid side walls to the lid front wall or the lid rear wall.

* * * * *